United States Patent [19]

Wu

[11] 3,991,981

[45] Nov. 16, 1976

[54] BALUSTRADE WITH ADJUSTABLE SUPPORTING BALUSTERS

[76] Inventor: Sin An Wu, 228, Sec. 3, Pa-Te Road, Taipei, China /Taiwan

[22] Filed: Aug. 11, 1975

[21] Appl. No.: 603,775

[52] U.S. Cl. ..... 256/65

[51] Int. Cl.[2] ..... E04H 17/14

[58] Field of Search ..... 256/65, 66, 68, 69, 256/59, 19

[56] References Cited

UNITED STATES PATENTS

| | | | |
|---|---|---|---|
| 2,820,613 | 1/1958 | Schilling | 256/65 |
| 2,869,829 | 1/1959 | Spangberg | 256/65 |
| 3,689,032 | 9/1972 | Von Wedel et al. | 256/59 |
| 3,704,004 | 11/1972 | Carter, Jr. | 256/59 |

*Primary Examiner*—Werner H. Schroeder
*Assistant Examiner*—Doris L. Troutman

[57] ABSTRACT

A balustrade comprising an elongated hand rail having longitudinal guide grooves formed along the two lateral sides thereof, a plurality of resilient connectors slidably engaged in said grooves, and a plurality of supporting balusters connected to the hand rail through said connectors. A tapered recess having a threaded peripheral wall is provided at the bottom of each connector for receiving a threaded end of the baluster. The connector can be slidably adjusted to any desirable position along the grooves before the baluster is connected thereto, and when the baluster is screwed into the tapered portion of the recess by some external force, the resilient connector is forced to expand with part or all of its surface abutting against the inner surface of the hand rail whereby to keep the baluster in position. The other ends of the balusters are then fixed to the ground to complete the balustrade.

1 Claim, 10 Drawing Figures

BALUSTRADE WITH ADJUSTABLE SUPPORTING BALUSTERS

BACKGROUND OF THE INVENTION

1. Field of the Invention

This invention relates to a balustrade with adjustable supporting balusters.

2. Brief Description of the Prior Art

In a conventional balustrade, the supporting balusters thereof are soldered to the hand rail, and as a result the space between any two adjacent balusters is fixed. Because of this solder connection, a balustrade cannot be readily set up without using special tools. Also, the finished balustrades are both heavy and bulky, and are therefore inconvenient for shipment.

BRIEF SUMMARY OF THE INVENTION

An object of the present invention is to obviate or mitigate the above difficulties by providing a novel balustrade wherein the balusters may be arbitrarily adjusted to any desired positions and then fixed in situ.

Another object of the present invention is to provide a balustrade wherein the supporting balusters can be separately produced and then shipped to the place under construction where they are detachably engaged on the hand rail of the balustrade.

BRIEF DESCRIPTION OF THE DRAWINGS

Other objects and advantages of the present invention will be apparent from the following detailed description of a preferred embodiment with reference to the accompanying drawings where.

DETAILED DESCRIPTION OF THE PREFERRED EMBODIMENT

According to the present invention, the balustrade comprises an elongated hand rail having guide grooves formed therein along its whole length, a plurality of resilient connectors slidably engaged in said grooves, and a plurality of supporting balusters to be connected to the hand rail through said connectors. A recess having a threaded taper wall is formed in each connector for receiving the threaded end of a baluster. The connectors can be slidably adjusted to any desirable positions before the balusters are connected. Then, upon screwing the threaded end of the baluster into the tapered recess, the whole resilient connector is forced to expand with all or part of its outer surface finally abutted against the hand rail, thereby to fix the baluster in position. Then the other ends of the balusters are inserted into a plurality of holes performed on the ground to complete the balustrade.

Figure 1:
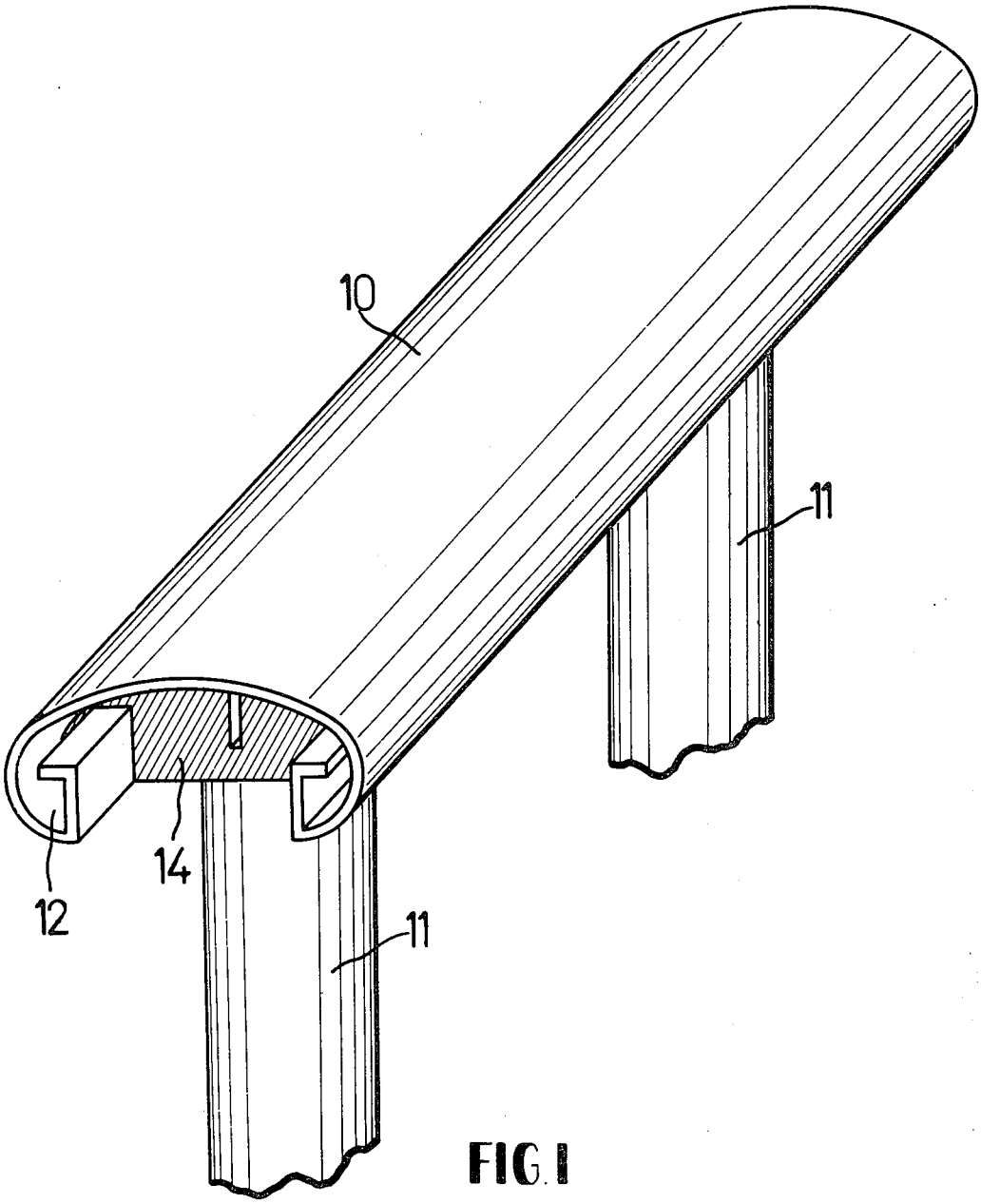
FIG. 1 is a perspective view of a finished balustrade according to the present invention.

Referring to FIG. 1, the balustrade according to the present invention comprises three detachable parts: an elongated hand rail 10, a plurality of arbitrarily spaced balusters 11, and a plurality of connectors 14 connecting the balusters to the hand rail. Such a balustrade may be set up for example along either side of a staircase to serve as a hand support for people coming up and down.

Figure 2:
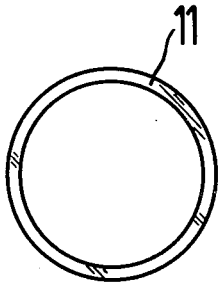
FIG. 2 is a plan view of a supporting baluster.
Figure 3:
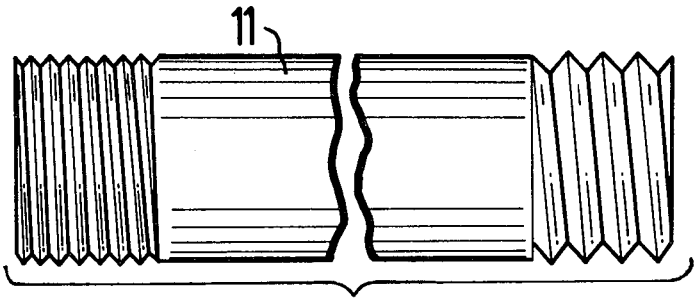
FIG. 3 is a front view of the baluster shown in FIG. 2 the baluster being shown in a 90° rotated position for convenience only.
Figure 4:
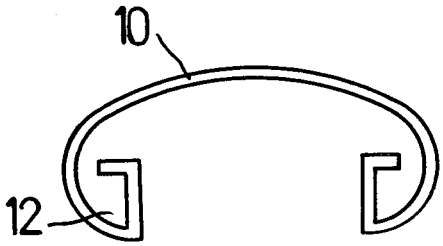
FIG. 4 is a front view of a hand rail with grooves formed therein.
Figure 5:
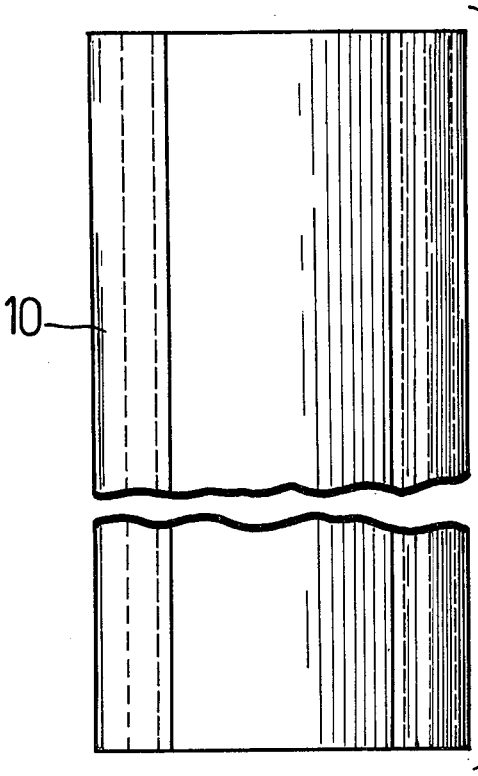
FIG. 5 is a plan view of the hand rail shown in FIG. 4.

The hand rail 10 is usually in the form of an elongated steel sheet having a curved upper surface. The two lateral sides of the hand rail according to the present invention are curled in so that a guide groove 12 is formed on each side and extends along the whole length of the hand rail, as can be seen from FIGS. 1, 4, and 5. The balusters could be in the form of hollow cylinders with one end thereof threaded for engagement with the connectors 14, as shown in FIGS. 2 and 3.

Figure 6:
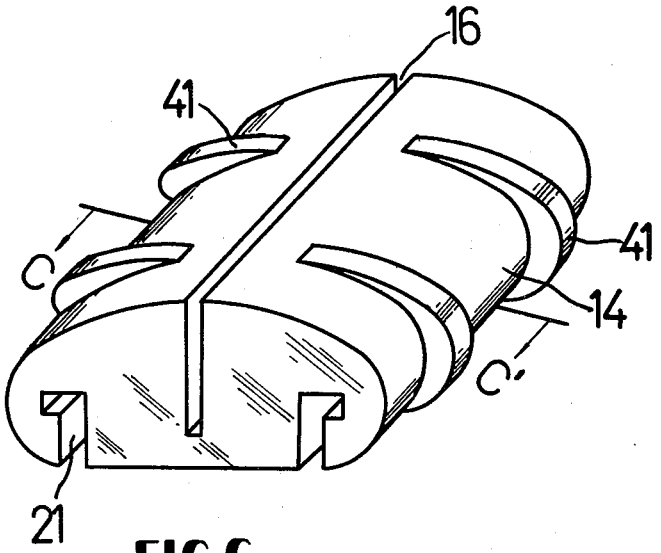
FIG. 6 is a perspective view of a connector through which the baluster is connected to the hand rail.
Figure 7:
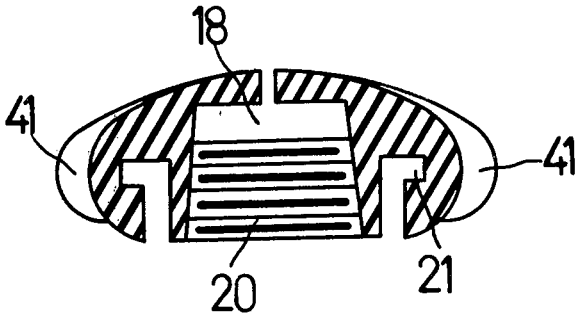
FIG. 7 is a sectional view taken along the line C–C′ of FIG. 6.

FIGS. 6 and 7 show the connectors 14 in detail. The connectors according to the present invention are made of resilient material, and a longitudinal slit 16 is formed along the center line of the top surface of each connector in order to further increase the resiliency of the connector. The connector has a curved upper surface conformable to but slightly smaller than the curved inner surface of the hand rail. The two lateral sides of the connectors are also curled in a co-operating passage 21, so that they can be received into the guide grooves 12 of the hand rail, whereby the connectors are freely slidable to any selected position in the grooves, as shown in FIG. 1. A plurality of arms 41 are provided which protrude laterally for abutting against the inner surface of the hand rail when the connector is forced to expand by the screwing in of a baluster, as to be detailed herebelow.

As shown in FIG. 7, a circular recess 18 is formed at the bottom of each connector. Such recess has a tapered peripheral wall with threads 20 provided thereon. It is designed such that the threaded end of the baluster can just be engaged into the largest, or the lowest, portion of the recess without causing any deformation of the connector. Then, when the baluster is further screwed into the tapered recess by some additional force, with the help of the slit 31, the resilient connector will be forced to expand laterally causing the protruded arms 41 to abut tightly against the inner surface of the hand rail, whereby to connect and fix the baluster to the hand rail.

The lower ends of the balusters can be fixed to the floor or the ground by any conventional methods. However, two additional preferable methods are further disclosed below.

Figure 8:
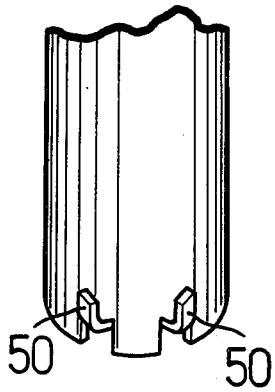
FIG. 8 is a front view of the lower part of a baluster embodiment according to the present invention.

The first method is characterized by the special construction of the lower parts of the balusters. As shown in FIG. 8, a part of the lower outer surface of the baluster is bent upward to form a plurality of spaced peripheral blades 50. Then, the lower part of the baluster is inserted into a cavity formed on the floor or the ground. The cavity is then filled with cement and upon cooling the baluster will be fixed firmly in position. Because of the presence of the peripheral blades, the rotation of the baluster inside the cavity is prevented, whereby to further prevent the upper end of the baluster from unscrewing from the connector.

Figure 9A:
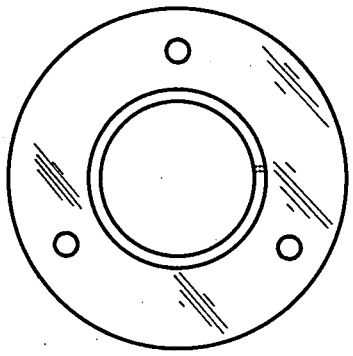
FIGS. 9A and 9B show both the plan and the front views of a seat for receiving a baluster.
Figure 9B:
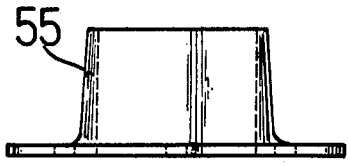

The second method of fixing the balusters to the ground is to provide a plurality of baluster seats which have upright cylinder portions conformable to but slightly larger than the lower parts of the cylindrical balusters. A plurality of cavities are first formed on the ground and into each of these cavities metal lead is injected. Then, the seats 55 are fixed into the cavities by using for instance three bolts as shown in FIG. 9. The lower ends of the balusters are finally received into the cylindrical portions of the seats and fixed thereto by either inserting some fillers between the two cylinders or using a bolt passing through a small hole formed on the cylindrical wall of the baluster seat, as shown in FIG. 9.

According to the present invention, the balustrade is separable into three parts, each of which can be separately manufactured in a manufacturing plant and then shipped to the place of interest where the parts are readily assembled to set up a balustrade. In this manner, the cost of the balustrade is greatly reduced, and the transportation problem is readily solved.

What I claim is:

1. A balustrade comprising: an elongated hand rail having longitudinal guide grooves formed therein; a plurality of connectors made up of resilient material and slidably engaged in said grooves; and a plurality of supporting balusters detachably connected to the hand rail through said connectors, characterized in that a plurality of arms are provided on the resilient connectors and protrude laterally therefrom toward the inner surface of the hand rail, a slit is provided on the surface of the connector to increase the resilience thereof, and a recess having a threaded taper wall is provided at the bottom of each connector for receiving the threaded end of the baluster so that when the baluster is loosely screwed in the recess of the connector the latter is slidable in the guide grooves to any desirable position, and when the baluster is loosely screwed in the recess of the connector the latter is slidable in the guide grooves to any desirable position, and when the baluster is further screwed into the tapered recess by some external force the connector is forced to expand toward the inner surface of the hand rail with said laterally protruded arms thereof abutting tightly against the inner surface of the hand rail whereby to fix the baluster in position.

* * * * *